US011913170B2

(12) United States Patent
Sealey et al.

(10) Patent No.: US 11,913,170 B2
(45) **Date of Patent: *Feb. 27, 2024**

(54) FORMER OF WATER LAID ASSET THAT UTILIZES A STRUCTURED FABRIC AS THE OUTER WIRE

(71) Applicant: STRUCTURED I, LLC, Great Neck, NY (US)

(72) Inventors: James E. Sealey, Belton, SC (US); Byrd Tyler Miller, IV, Easley, SC (US)

(73) Assignee: STRUCTURED I, LLC, Great Neck, NY (US)

( * ) Notice: Subject to any disclaimer, the term of this patent is extended or adjusted under 35 U.S.C. 154(b) by 219 days.

This patent is subject to a terminal disclaimer.

(21) Appl. No.: 17/382,600

(22) Filed: Jul. 22, 2021

(65) Prior Publication Data

US 2021/0348333 A1 Nov. 11, 2021

Related U.S. Application Data

(63) Continuation of application No. 16/537,911, filed on Aug. 12, 2019, now Pat. No. 11,098,448, which is a (Continued)

(51) Int. Cl.
*D21F 1/00* (2006.01)
*D21F 9/00* (2006.01)
(Continued)

(52) U.S. Cl.
CPC ..... *D21F 1/0036* (2013.01); *D21F 1/0027* (2013.01); *D21F 3/08* (2013.01);
(Continued)

(58) Field of Classification Search
CPC ..... D21F 1/0036; D21F 1/0027; D21F 3/08; D21F 5/182; D21F 5/004; D21F 5/14;
(Continued)

(56) References Cited

U.S. PATENT DOCUMENTS 2,919,467 A 1/1960 Mercer
2,926,154 A 2/1960 Keim
(Continued)

FOREIGN PATENT DOCUMENTS

CA 2168894 A1 8/1997
CA 2795139 A1 10/2011
(Continued)

OTHER PUBLICATIONS

International Search Report of PCT/US17/51158 dated Nov. 28, 2017.
(Continued)

*Primary Examiner* — Dennis R Cordray
(74) *Attorney, Agent, or Firm* — Amster, Rothstein & Ebenstein LLP

(57) ABSTRACT

A method of forming a fibrous web including the steps of providing a fiber slurry, depositing the fiber slurry between an inner forming wire and an outer forming wire, wherein the outer forming wire comprises a structured fabric and the inner forming wire contacts a segment of a forming roll, and rotating the forming roll so that the fiber slurry moves into contact with the structured fabric.

15 Claims, 2 Drawing Sheets

Related U.S. Application Data continuation of application No. 15/702,291, filed on Sep. 12, 2017, now Pat. No. 10,422,078.

(60) Provisional application No. 62/393,468, filed on Sep. 12, 2016.

(51) Int. Cl.

| | |
|---|---|
| ***D21F 11/00*** | (2006.01) |
| ***D21F 11/14*** | (2006.01) |
| ***D21F 3/08*** | (2006.01) |
| ***D21F 5/00*** | (2006.01) |
| ***D21F 5/14*** | (2006.01) |
| ***D21F 5/18*** | (2006.01) |
| ***D21G 1/00*** | (2006.01) |

(52) U.S. Cl.

CPC ..... *D21F 5/004* (2013.01); *D21F 5/14* (2013.01); *D21F 5/182* (2013.01); *D21F 9/006* (2013.01); *D21F 11/006* (2013.01); *D21F 11/14* (2013.01); *D21G 1/00* (2013.01)

(58) Field of Classification Search

CPC ..... D21F 9/003; D21F 9/006; D21F 11/006; D21F 11/14; D21G 1/00

See application file for complete search history.

(56) References Cited

U.S. PATENT DOCUMENTS 3,026,231 A 3/1962 Chavannes
3,049,469 A 8/1962 Davison
3,058,873 A 10/1962 Keim et al.
3,066,066 A 11/1962 Keim et al.
3,097,994 A 7/1963 Dickens et al.
3,125,552 A 3/1964 Loshaek et al.
3,143,150 A 8/1964 Buchanan
3,186,900 A 6/1965 De Young
3,197,427 A 7/1965 Schmatz
3,224,986 A 12/1965 Butler et al.
3,224,990 A 12/1965 Babcock
3,227,615 A 1/1966 Koren
3,227,671 A 1/1966 Kelm
3,239,491 A 3/1966 Tsou et al.
3,240,664 A 3/1966 Earle, Jr.
3,240,761 A 3/1966 Keim et al.
3,248,280 A 4/1966 Hyland, Jr.
3,250,664 A 5/1966 Conet et al.
3,252,181 A 5/1966 Hureau
3,301,746 A 1/1967 Sanford et al.
3,311,594 A 3/1967 Earle, Jr.
3,329,657 A 7/1967 Strazdins et al.
3,332,834 A 7/1967 Reynolds, Jr.
3,332,901 A 7/1967 Keim
3,352,833 A 11/1967 Earle, Jr.
3,384,692 A 5/1968 Galt et al.
3,414,459 A 12/1968 Wells
3,442,754 A 5/1969 Espy
3,459,697 A 8/1969 Goldberg et al.
3,473,576 A 10/1969 Amneus
3,483,077 A 12/1969 Aldrich
3,545,165 A 12/1970 Greenwell
3,556,932 A 1/1971 Coscia et al.
3,573,164 A 3/1971 Friedberg et al.
3,609,126 A 9/1971 Asao et al.
3,666,609 A 5/1972 Kalwaites et al.
3,672,949 A 6/1972 Brown
3,672,950 A 6/1972 Murphy et al.
3,773,290 A 11/1973 Mowery
3,778,339 A 12/1973 Williams et al.
3,813,362 A 5/1974 Coscia et al.
3,855,158 A 12/1974 Petrovich et al.
3,877,510 A 4/1975 Tegtmeier et al.
3,905,863 A 9/1975 Ayers
3,911,173 A 10/1975 Sprague, Jr.
3,974,025 A 8/1976 Ayers
3,994,771 A 11/1976 Morgan, Jr. et al.
3,998,690 A 12/1976 Lyness et al.
4,038,008 A 7/1977 Larsen
4,075,382 A 2/1978 Chapman et al.
4,088,528 A 5/1978 Berger et al.
4,098,632 A 7/1978 Sprague, Jr.
4,102,737 A 7/1978 Morton
4,129,528 A 12/1978 Petrovich et al.
4,147,586 A 4/1979 Petrovich et al.
4,184,519 A 1/1980 McDonald et al.
4,190,692 A 2/1980 Larsen
4,191,609 A 3/1980 Trokhan
4,252,761 A 2/1981 Schoggen et al.
4,320,162 A 3/1982 Schulz
4,331,510 A 5/1982 Wells
4,382,987 A 5/1983 Smart
4,440,597 A 4/1984 Wells et al.
4,501,862 A 2/1985 Keim
4,507,351 A 3/1985 Johnson et al.
4,514,345 A 4/1985 Johnson et al.
4,515,657 A 5/1985 Maslanka
4,528,239 A 7/1985 Trokhan
4,529,480 A 7/1985 Trokhan
4,537,657 A 8/1985 Keim
4,545,857 A 10/1985 Wells
4,637,859 A 1/1987 Trokhan
4,676,590 A 6/1987 Priaroggia
4,714,736 A 12/1987 Juhl et al.
4,770,920 A 9/1988 Larsonneur
4,780,357 A 10/1988 Akao
4,808,467 A 2/1989 Suskind et al.
4,836,894 A 6/1989 Chance et al.
4,849,054 A 7/1989 Klowak
4,885,202 A 12/1989 Lloyd et al.
4,891,249 A 1/1990 McIntyre
4,909,284 A 3/1990 Kositzke
4,949,668 A 8/1990 Heindel et al.
4,949,686 A 8/1990 Bayless
4,983,256 A 1/1991 Combette et al.
4,996,091 A 2/1991 McIntyre
5,059,282 A 10/1991 Ampulski et al.
5,143,776 A 9/1992 Givens
5,149,401 A 9/1992 Langevin et al.
5,152,874 A 10/1992 Keller
5,211,813 A 5/1993 Sawley et al.
5,239,047 A 8/1993 Devore et al.
5,279,098 A 1/1994 Fukuda
5,281,306 A 1/1994 Kakiuchi et al.
6,303,233 B1 4/1994 Sugawara
5,334,289 A 8/1994 Trokhan et al.
5,347,795 A 9/1994 Fukuda
5,397,435 A 3/1995 Ostendorf et al.
5,399,412 A 3/1995 Sudall et al.
5,405,501 A 4/1995 Phan et al.
5,409,572 A 4/1995 Kershaw et al.
5,429,686 A 7/1995 Chiu et al.
5,439,559 A 8/1995 Crouse
5,447,012 A 9/1995 Kovacs et al.
5,470,436 A 11/1995 Wagle et al.
5,487,313 A 1/1996 Johnson
5,509,913 A 4/1996 Yeo
5,510,002 A 4/1996 Hermans et al.
5,529,665 A 6/1996 Kaun
5,581,906 A 12/1996 Ensign et al.
5,591,147 A 1/1997 Couture-Dorschner et al.
5,607,551 A 3/1997 Farrington, Jr. et al.
5,611,890 A 3/1997 Vinson et al.
5,628,876 A 5/1997 Ayers et al.
5,635,028 A 6/1997 Vinson et al.
5,649,916 A 7/1997 Dipalma et al.
5,671,897 A 9/1997 Ogg et al.
5,672,248 A 9/1997 Wendt et al.
5,679,222 A 10/1997 Rasch et al.
5,685,428 A 11/1997 Herbers et al.
5,728,268 A 3/1998 Weisman et al.
5,746,887 A 5/1998 Wendt et al.
5,753,067 A 5/1998 Fukuda et al.
5,772,845 A 6/1998 Farrington, Jr. et al.

(56) References Cited

U.S. PATENT DOCUMENTS

| | | | |
|---|---|---|---|
| 5,806,569 | A | 9/1998 | Gulya et al. |
| 5,827,384 | A | 10/1998 | Canfield et al. |
| 5,832,962 | A | 11/1998 | Kaufman et al. |
| 5,846,380 | A | 12/1998 | Van Phan et al. |
| 5,855,738 | A | 1/1999 | Weisman et al. |
| 5,858,554 | A | 1/1999 | Neal et al. |
| 5,865,396 | A | 2/1999 | Ogg et al. |
| 5,865,950 | A | 2/1999 | Vinson et al. |
| 5,893,965 | A | 4/1999 | Trokhan et al. |
| 5,913,765 | A | 6/1999 | Burgess et al. |
| 5,942,085 | A | 8/1999 | Neal et al. |
| 5,944,954 | A | 8/1999 | Vinson et al. |
| 5,948,210 | A | 9/1999 | Huston |
| 5,980,691 | A | 11/1999 | Weisman et al. |
| 6,036,139 | A | 3/2000 | Ogg |
| 6,039,838 | A | 3/2000 | Kaufman et al. |
| 6,048,938 | A | 4/2000 | Neal et al. |
| 6,060,149 | A | 5/2000 | Nissing et al. |
| 6,106,670 | A | 8/2000 | Weisman et al. |
| 6,149,769 | A | 11/2000 | Mohammadi et al. |
| 6,162,327 | A | 12/2000 | Batra et al. |
| 6,162,329 | A | 12/2000 | Vinson et al. |
| 6,187,138 | B1 | 2/2001 | Neal et al. |
| 6,200,419 | B1 | 3/2001 | Phan |
| 6,203,667 | B1 | 3/2001 | Huhtelin |
| 6,207,734 | B1 | 3/2001 | Vinson et al. |
| 6,231,723 | B1 | 5/2001 | Kanitz et al. |
| 6,287,426 | B1 | 9/2001 | Edwards et al. |
| 6,319,362 | B1 | 11/2001 | Huhtelin et al. |
| 6,344,111 | B1 | 2/2002 | Wilhelm |
| 6,420,013 | B1 | 7/2002 | Vinson et al. |
| 6,420,100 | B1 | 7/2002 | Trokhan et al. |
| 6,423,184 | B2 | 7/2002 | Vahatalo et al. |
| 6,458,246 | B1 | 10/2002 | Kanitz et al. |
| 6,464,831 | B1 | 10/2002 | Trokhan et al. |
| 6,473,670 | B1 | 10/2002 | Huhtelin |
| 6,521,089 | B1 | 2/2003 | Griech et al. |
| 6,537,407 | B1 | 3/2003 | Law et al. |
| 6,547,928 | B2 | 4/2003 | Barnholtz et al. |
| 6,551,453 | B2 | 4/2003 | Weisman et al. |
| 6,551,691 | B1 | 4/2003 | Hoeft et al. |
| 6,572,722 | B1 | 6/2003 | Pratt |
| 6,579,416 | B1 | 6/2003 | Vinson et al. |
| 6,602,454 | B2 | 8/2003 | McGuire et al. |
| 6,607,637 | B1 | 8/2003 | Vinson et al. |
| 6,610,173 | B1 | 8/2003 | Lindsay et al. |
| 6,613,194 | B2 | 9/2003 | Kanitz et al. |
| 6,660,362 | B1 | 12/2003 | Lindsay et al. |
| 6,673,202 | B2 | 1/2004 | Burazin |
| 6,701,637 | B2 | 5/2004 | Lindsay et al. |
| 6,755,939 | B2 | 6/2004 | Vinson et al. |
| 6,773,647 | B2 | 8/2004 | McGuire et al. |
| 6,797,117 | B1 | 9/2004 | McKay et al. |
| 6,808,599 | B2 | 10/2004 | Burazin |
| 6,821,386 | B2 | 11/2004 | Weisman et al. |
| 6,821,391 | B2 | 11/2004 | Scherb et al. |
| 6,827,818 | B2 | 12/2004 | Farrington, Jr. et al. |
| 6,863,777 | B2 | 3/2005 | Kanitz et al. |
| 6,896,767 | B2 | 5/2005 | Wilhelm |
| 6,939,443 | B2 | 9/2005 | Ryan et al. |
| 6,998,017 | B2 | 2/2006 | Lindsay et al. |
| 6,998,024 | B2 | 2/2006 | Burazin |
| 7,005,043 | B2 | 2/2006 | Toney et al. |
| 7,014,735 | B2 | 3/2006 | Kramer et al. |
| 7,105,465 | B2 | 9/2006 | Patel et al. |
| 7,155,876 | B2 | 1/2007 | VanderTuin et al. |
| 7,157,389 | B2 | 1/2007 | Branham et al. |
| 7,182,837 | B2 | 2/2007 | Chen et al. |
| 7,194,788 | B2 | 3/2007 | Clark et al. |
| 7,235,156 | B2 | 6/2007 | Baggot |
| 7,269,929 | B2 | 9/2007 | VanderTuin et al. |
| 7,294,230 | B2 | 11/2007 | Flugge-Berendes et al. |
| 7,311,853 | B2 | 12/2007 | Vinson et al. |
| 7,328,550 | B2 | 2/2008 | Floding et al. |
| 7,339,378 | B2 | 3/2008 | Han et al. |
| 7,351,307 | B2 | 4/2008 | Scherb et al. |
| 7,387,708 | B2 | 6/2008 | Herman et al. |
| 7,399,378 | B2 | 7/2008 | Edwards et al. |
| 7,419,569 | B2 | 9/2008 | Hermans |
| 7,427,434 | B2 | 9/2008 | Busam |
| 7,431,801 | B2 | 10/2008 | Conn et al. |
| 7,432,309 | B2 | 10/2008 | Vinson |
| 7,442,278 | B2 | 10/2008 | Murray et al. |
| 7,452,447 | B2 | 11/2008 | Duan et al. |
| 7,476,293 | B2 | 1/2009 | Herman et al. |
| 7,494,563 | B2 | 2/2009 | Edwards et al. |
| 7,510,631 | B2 | 3/2009 | Scherb et al. |
| 7,513,975 | B2 | 4/2009 | Burma |
| 7,563,344 | B2 | 7/2009 | Beuther |
| 7,582,187 | B2 | 9/2009 | Scherb et al. |
| 7,611,607 | B2 | 11/2009 | Mullally et al. |
| 7,622,020 | B2 | 11/2009 | Awofeso |
| 7,662,462 | B2 | 2/2010 | Noda |
| 7,670,678 | B2 | 3/2010 | Phan |
| 7,683,126 | B2 | 3/2010 | Neal et al. |
| 7,686,923 | B2 | 3/2010 | Scherb et al. |
| 7,687,140 | B2 | 3/2010 | Manifold et al. |
| 7,691,230 | B2 | 4/2010 | Scherb et al. |
| 7,744,722 | B1 | 6/2010 | Tucker et al. |
| 7,744,726 | B2 | 6/2010 | Scherb et al. |
| 7,785,443 | B2 | 8/2010 | Hermans et al. |
| 7,799,382 | B2 | 9/2010 | Payne et al. |
| 7,811,418 | B2 | 10/2010 | Klerelid et al. |
| 7,815,978 | B2 | 10/2010 | Davenport et al. |
| 7,823,366 | B2 | 11/2010 | Schoeneck |
| 7,842,163 | B2 | 11/2010 | Nickel et al. |
| 7,867,361 | B2 | 1/2011 | Salaam et al. |
| 7,871,692 | B2 | 1/2011 | Morin et al. |
| 7,887,673 | B2 | 2/2011 | Andersson et al. |
| 7,905,989 | B2 | 3/2011 | Scherb et al. |
| 7,914,866 | B2 | 3/2011 | Shannon et al. |
| 7,931,781 | B2 | 4/2011 | Scherb et al. |
| 7,951,269 | B2 | 5/2011 | Herman et al. |
| 7,955,549 | B2 | 6/2011 | Noda |
| 7,959,764 | B2 | 6/2011 | Ringer et al. |
| 7,972,475 | B2 | 7/2011 | Chan et al. |
| 7,989,058 | B2 | 8/2011 | Manifold et al. |
| 8,034,463 | B2 | 10/2011 | Leimbach et al. |
| 8,051,629 | B2 | 11/2011 | Pazdernik et al. |
| 8,075,739 | B2 | 12/2011 | Scherb et al. |
| 8,092,652 | B2 | 1/2012 | Scherb et al. |
| 8,118,979 | B2 | 2/2012 | Herman et al. |
| 8,147,649 | B1 | 4/2012 | Tucker et al. |
| 8,152,959 | B2 | 4/2012 | Elony et al. |
| 8,196,314 | B2 | 6/2012 | Munch |
| 8,216,427 | B2 | 7/2012 | Klerelid et al. |
| 8,236,135 | B2 | 8/2012 | Prodoehl et al. |
| 8,303,773 | B2 | 11/2012 | Scherb et al. |
| 8,382,956 | B2 | 2/2013 | Boechat et al. |
| 8,402,673 | B2 | 3/2013 | Da Silva et al. |
| 8,409,404 | B2 | 4/2013 | Harper et al. |
| 8,435,384 | B2 | 5/2013 | Da Silva et al. |
| 8,440,055 | B2 | 5/2013 | Scherb et al. |
| 8,445,032 | B2 | 5/2013 | Topolkaraev et al. |
| 8,454,800 | B2 | 6/2013 | Mourad et al. |
| 8,470,133 | B2 | 6/2013 | Cunnane et al. |
| 8,506,756 | B2 | 8/2013 | Denis et al. |
| 8,544,184 | B2 | 10/2013 | Da Silva et al. |
| 8,574,211 | B2 | 11/2013 | Morita |
| 8,580,083 | B2 | 11/2013 | Boechat et al. |
| 8,728,277 | B2 | 5/2014 | Boechat et al. |
| 8,758,569 | B2 | 6/2014 | Aberg et al. |
| 8,771,466 | B2 | 7/2014 | Denis et al. |
| 8,801,903 | B2 | 8/2014 | Mourad et al. |
| 8,815,057 | B2 | 8/2014 | Eberhardt et al. |
| 8,822,009 | B2 | 9/2014 | Riviere et al. |
| 8,968,517 | B2 | 3/2015 | Ramaratnam et al. |
| 8,980,062 | B2 | 3/2015 | Karlsson et al. |
| 9,005,710 | B2 | 4/2015 | Jones et al. |
| D734,617 | S | 7/2015 | Seitzinger et al. |
| 9,095,477 | B2 | 8/2015 | Yamaguchi |
| D738,633 | S | 9/2015 | Seitzinger et al. |
| 9,382,666 | B2 | 7/2016 | Ramaratnam et al. |
| 9,506,203 | B2 | 11/2016 | Ramaratnam et al. |

(56) References Cited

U.S. PATENT DOCUMENTS 9,580,872 B2 2/2017 Ramaratnam et al.
9,702,089 B2 7/2017 Ramaratnam et al.
9,702,090 B2 7/2017 Ramaratnam et al.
9,719,213 B2 8/2017 Miller, IV et al.
9,725,853 B2 8/2017 Ramaratnam et al.
10,422,078 B2 9/2019 Sealey et al.
11,098,448 B2 * 8/2021 Sealey ..... D21F 1/0036
2001/0018068 A1 8/2001 Lorenzi et al.
2002/0028230 A1 3/2002 Eichhorn et al.
2002/0060049 A1 5/2002 Kanitz et al.
2002/0061386 A1 5/2002 Carson et al.
2002/0098317 A1 7/2002 Jaschinski et al.
2002/0110655 A1 8/2002 Seth
2002/0115194 A1 8/2002 Lange et al.
2002/0117283 A1 8/2002 Soderholm et al.
2002/0125606 A1 9/2002 McGuire et al.
2003/0024674 A1 2/2003 Kanitz et al.
2003/0056911 A1 3/2003 Hermans et al.
2003/0056917 A1 3/2003 Jimenez
2003/0070781 A1 4/2003 Hermans et al.
2003/0114071 A1 6/2003 Everhart et al.
2003/0159401 A1 8/2003 Sorensson et al.
2003/0188843 A1 10/2003 Kanitz et al.
2003/0218274 A1 11/2003 Boutilier et al.
2004/0118531 A1 6/2004 Shannon et al.
2004/0123963 A1 7/2004 Chen et al.
2004/0126601 A1 7/2004 Kramer et al.
2004/0126710 A1 7/2004 Hill et al.
2004/0168784 A1 9/2004 Duan et al.
2004/0173333 A1 9/2004 Hermans et al.
2004/0234804 A1 11/2004 Liu et al.
2005/0016704 A1 1/2005 Huhtelin
2005/0069679 A1 3/2005 Stelljes et al.
2005/0069680 A1 3/2005 Stelljes et al.
2005/0098281 A1 5/2005 Schulz et al.
2005/0112115 A1 5/2005 Khan
2005/0123726 A1 6/2005 Broering et al.
2005/0130536 A1 6/2005 Siebers et al.
2005/0136222 A1 6/2005 Hada et al.
2005/0148257 A1 7/2005 Hermans et al.
2005/0150626 A1 7/2005 Kanitz et al.
2005/0166551 A1 8/2005 Keane et al.
2005/0241786 A1 11/2005 Edwards et al.
2005/0241788 A1 11/2005 Baggot et al.
2005/0252626 A1 11/2005 Chen et al.
2005/0280184 A1 12/2005 Sayers et al.
2005/0287340 A1 12/2005 Morelli et al.
2006/0005916 A1 1/2006 Stelljes et al.
2006/0013998 A1 1/2006 Stelljes et al.
2006/0019567 A1 1/2006 Sayers
2006/0083899 A1 4/2006 Burazin et al.
2006/0093788 A1 5/2006 Behm et al.
2006/0113049 A1 6/2006 Knobloch et al.
2006/0130986 A1 6/2006 Flugge-Berendes et al.
2006/0194022 A1 8/2006 Boutilier et al.
2006/0269708 A1 11/2006 Shannon et al.
2007/0020315 A1 1/2007 Shannon et al.
2007/0107863 A1 5/2007 Edwards et al.
2007/0131366 A1 6/2007 Underhill et al.
2007/0137813 A1 6/2007 Nickel et al.
2007/0137814 A1 6/2007 Gao
2007/0170610 A1 7/2007 Payne et al.
2007/0240842 A1 10/2007 Scherb et al.
2007/0251659 A1 11/2007 Fernandes et al.
2007/0251660 A1 11/2007 Walkenhaus et al.
2007/0267157 A1 11/2007 Kanitz et al.
2007/0272381 A1 11/2007 Elony et al.
2007/0275866 A1 11/2007 Dykstra
2007/0298221 A1 12/2007 Vinson
2008/0035289 A1 2/2008 Edwards et al.
2008/0078695 A1 3/2008 Uitenbroek et al.
2008/0156450 A1 7/2008 Klerelid et al.
2008/0199655 A1 8/2008 Monnerie et al.
2008/0245498 A1 10/2008 Ostendorf et al.
2008/0302493 A1 12/2008 Boatman et al.
2008/0308247 A1 12/2008 Ringer et al.
2009/0020248 A1 1/2009 Sumnicht et al.
2009/0056892 A1 3/2009 Rekoske
2009/0061709 A1 3/2009 Nakai et al.
2009/0205797 A1 8/2009 Fernandes et al.
2009/0218056 A1 9/2009 Manifold et al.
2010/0065234 A1 3/2010 Klerelid et al.
2010/0119779 A1 5/2010 Ostendorf et al.
2010/0224338 A1 9/2010 Harper et al.
2010/0230064 A1 9/2010 Eagles et al.
2010/0236034 A1 9/2010 Eagles et al.
2010/0239825 A1 9/2010 Sheehan et al.
2010/0272965 A1 10/2010 Schinkoreit et al.
2011/0027545 A1 2/2011 Harlacher et al.
2011/0180223 A1 7/2011 Klerelid et al.
2011/0189435 A1 8/2011 Manifold et al.
2011/0189442 A1 8/2011 Manifold et al.
2011/0206913 A1 8/2011 Manifold et al.
2011/0223381 A1 9/2011 Sauter et al.
2011/0253329 A1 10/2011 Manifold et al.
2011/0265967 A1 11/2011 Van Phan
2011/0303379 A1 12/2011 Boechat et al.
2012/0144611 A1 6/2012 Baker et al.
2012/0152475 A1 6/2012 Edwards et al.
2012/0177888 A1 7/2012 Escafere et al.
2012/0244241 A1 9/2012 McNeil
2012/0267063 A1 10/2012 Klerelid et al.
2012/0297560 A1 11/2012 Zwick et al.
2013/0008135 A1 1/2013 Moore et al.
2013/0029105 A1 1/2013 Miller et al.
2013/0029106 A1 1/2013 Lee et al.
2013/0133851 A1 5/2013 Boechat et al.
2013/0150817 A1 6/2013 Kainth et al.
2013/0160980 A1 6/2013 Hermans et al.
2013/0209749 A1 8/2013 Myangiro et al.
2013/0248129 A1 9/2013 Manifold et al.
2013/0327487 A1 12/2013 Espinosa et al.
2014/0004307 A1 1/2014 Sheehan
2014/0041820 A1 2/2014 Ramaratnam et al.
2014/0041822 A1 2/2014 Boechat et al.
2014/0050890 A1 2/2014 Zwick et al.
2014/0053994 A1 2/2014 Manifold et al.
2014/0096924 A1 4/2014 Rekoske et al.
2014/0182798 A1 7/2014 Polat et al.
2014/0242320 A1 8/2014 McNeil et al.
2014/0272269 A1 9/2014 Hansen
2014/0272747 A1 9/2014 Ciurkot
2014/0284237 A1 9/2014 Gosset
2014/0360519 A1 12/2014 George et al.
2015/0059995 A1 3/2015 Ramaratnam et al.
2015/0102526 A1 4/2015 Ward et al.
2015/0129145 A1 5/2015 Chou et al.
2015/0211179 A1 7/2015 Alias et al.
2015/0241788 A1 8/2015 Yamaguchi
2015/0330029 A1 11/2015 Ramaratnam et al.
2016/0060811 A1 3/2016 Riding et al.
2016/0090692 A1 3/2016 Eagles et al.
2016/0090693 A1 3/2016 Eagles et al.
2016/0130762 A1 5/2016 Ramaratnam et al.
2016/0145810 A1 5/2016 Miller, IV et al.
2016/0159007 A1 6/2016 Miller, IV et al.
2016/0160448 A1 6/2016 Miller, IV et al.
2016/0185041 A1 6/2016 Topolkaraev et al.
2016/0185050 A1 6/2016 Topolkaraev et al.
2016/0273168 A1 9/2016 Ramaratnam et al.
2016/0273169 A1 9/2016 Ramaratnam et al.
2016/0289897 A1 10/2016 Ramaratnam et al.
2016/0289898 A1 10/2016 Ramaratnam et al.
2017/0044717 A1 2/2017 Quigley
2017/0101741 A1 4/2017 Sealey et al.
2017/0167082 A1 6/2017 Ramaratnam et al.
2017/0226698 A1 8/2017 LeBrun et al.
2017/0233946 A1 8/2017 Sealey et al.

(56) References Cited

U.S. PATENT DOCUMENTS

| | | | |
|---|---|---|---|
| 2017/0253422 | A1 | 9/2017 | Anklam et al. |
| 2017/0268178 | A1 | 9/2017 | Ramaratnam et al. |

FOREIGN PATENT DOCUMENTS

| | | | |
|---|---|---|---|
| CN | 1138356 | A | 12/1996 |
| CN | 1207149 | A | 2/1999 |
| CN | 1244899 | A | 2/2000 |
| CN | 1268559 | A | 10/2000 |
| CN | 1377405 | A | 10/2002 |
| CN | 2728254 | Y | 9/2005 |
| DE | 4242539 | A1 | 8/1993 |
| EP | 0097036 | A2 | 12/1983 |
| EP | 0979895 | A1 | 2/2000 |
| EP | 1911574 | A1 | 1/2007 |
| EP | 1339915 | B1 | 7/2007 |
| EP | 2123826 | A2 | 5/2009 |
| GB | 946093 | A | 1/1964 |
| JP | 2013208298 | A | 10/2013 |
| JP | 2014213138 | A | 11/2014 |
| WO | 96/06223 | A1 | 2/1996 |
| WO | 200382550 | A2 | 10/2003 |
| WO | 200445834 | A1 | 6/2004 |
| WO | 2007070145 | A1 | 6/2007 |
| WO | 2008019702 | A1 | 2/2008 |
| WO | 2009006709 | A1 | 1/2009 |
| WO | 2009/061079 | A1 | 5/2009 |
| WO | 2009067079 | A1 | 5/2009 |
| WO | 2011028823 | A1 | 3/2011 |
| WO | 2012003360 | A2 | 1/2012 |
| WO | 2013024297 | A1 | 2/2013 |
| WO | 2013136471 | A1 | 9/2013 |
| WO | 2014/022848 | A1 | 2/2014 |
| WO | 201500755 | A1 | 1/2015 |
| WO | 2015/176063 | A1 | 11/2015 |
| WO | 2016/077594 | A1 | 5/2016 |
| WO | 2016/086019 | A1 | 6/2016 |
| WO | 2016/090242 | A1 | 6/2016 |
| WO | 2016/090364 | A1 | 6/2016 |
| WO | 2016085704 | A1 | 6/2016 |
| WO | 2017066465 | A1 | 4/2017 |
| WO | 2017066656 | A1 | 4/2017 |
| WO | 2017139786 | A1 | 8/2017 |

OTHER PUBLICATIONS

International Search Report for PCT/US16/56871 dated Jan. 12, 2017.

Written Opinion of International Searching Authority for PCT/US16/56871 dated Jan. 12, 2017.

International Search Report for PCT/US2016/057163 dated Dec. 23, 2016.

Written Opinion of International Searching Authority for PCT/US2016/057163 dated Dec. 23, 2016.

International Search Report for PCT/US2017/029890 dated Jul. 14, 2017.

Written Opinion of International Searching Authority for PCT/US2017/029890 dated Jul. 14, 2017.

International Search Report for PCT/US2017/032746 dated Aug. 7, 2017.

Written Opinion of International Searching Authority for PCT/US2017/032746 dated Aug. 7, 2017.

International Search Report for PCT/US17/17705 dated Jun. 9, 2017.

Written Opinion of International Searching Authority for PCT/US17/17705 dated Jun. 9, 2017.

Written Opinion of International Searching Authority for PCT/US15/62483 dated May 6, 2016,.

International Search Report for PCT/US15/63986 dated Mar. 29, 2016.

Written Opinion of International Searching Authority for PCT/US15/63986 dated Mar. 29, 2016.

International Search Report for PCT/US15/64284 dated Feb. 11, 2016.

Written Opinion of International Searching Authority for PCT/US15/64284 dated Feb. 11, 2016.

International Search Report for PCT/US13/53593 dated Dec. 30, 2013.

Written Opinion of International Searching Authority for PCT/US13/53593 dated Dec. 30, 2013.

International Search Report for PCT/US15/31411 dated Aug. 13, 2015.

Written Opinion of International Searching Authority for PCT/US15/31411 dated Aug. 13, 2015.

International Search Report for PCT/US15/60398 dated Jan. 29, 2016.

Written Opinion of International Searching Authority for PCT/US15/60398 dated Jan. 29, 2016.

International Search Report for PCT/US15/62483 dated May 6, 2016.

International Preliminary Report on Patentability of PCT/US2013/053593 dated Feb. 3, 2015.

Supplementary European Search Report of EP 13 82 6461 dated Apr. 1, 2016.

* cited by examiner

FORMER OF WATER LAID ASSET THAT UTILIZES A STRUCTURED FABRIC AS THE OUTER WIRE

RELATED APPLICATIONS

This application is a continuation of U.S. patent application Ser. No. 16/537,911, filed Aug. 12, 2019 and entitled FORMER OF WATER LAID ASSET THAT UTILIZES A STRUCTURED FABRIC AS THE OUTER WIRE, which in turn is a continuation of U.S. patent application Ser. No. 15/702,291, filed Sep. 12, 2017 and entitled FORMER OF WATER LAID ASSET THAT UTILIZES A STRUCTURED FABRIC AS THE OUTER WIRE, which in turn claims priority to U.S. Provisional Application No. 62/393,468, filed Sep. 12, 2016 and entitled FORMER OF WATER LAID ASSET THAT UTILIZES A STRUCTURED FABRIC AS THE OUTER WIRE, and the contents of these applications are incorporated herein by reference in their entirety.

FIELD OF THE INVENTION

The present invention relates to systems and methods for making an absorbent structure utilizing a water laid asset with a structured fabric

BACKGROUND

Across the globe there is great demand for disposable products including towel, sanitary tissue, and facial tissue. Important quality attributes of disposable sanitary tissue and facial tissue include softness and strength, while those of disposable towel include absorbency and strength. The various methods used to produce these products vary in their ability to generate these quality attributes.

Use of a structured fabric can deliver superior levels of bulk that improve absorbency and bulk softness of absorbent structures in disposable products. The higher the bulk and absorbency desired, the higher coarseness structured fabric that needs be utilized. A coarse fabric uses thick monofilament polymeric fibers to create deep valleys in the fabric for cellulosic or synthetic fibers (which compromise the absorbent structure) to penetrate and generate bulk. In structured fabrics made using topically applied and cured resin, an increased resin thickness is needed in order to obtain higher bulk. The downside of using these highly coarse or thick structured fabrics is that the surface smoothness will be negatively impacted. Further, when using TAD, UCTAD, ETAD, or the ATMOS (Twin Wire Configuration) methods (employing a structured fabric) to produce an absorbent structure, the fibers of the absorbent structure penetrate into the structured fabric through the application of vacuum pressure or as an effect of the speed differential between the absorbent structure and the structured fabric. These methods limit the maximum penetration depth and correspondingly, bulk that can be achieved. In an ATMOS process that utilizes a crescent former, the absorbent structure is formed directly between a wire and structured fabric, however, the structured fabric is placed in the inner position (with the structured fabric located between the absorbent structure and the forming roll) rather than the outer position (with the structured fabric located between the absorbent structure and the saveall pan). This means that the drainage of the absorbent structure occurs through the outer wire rather than the structured fabric. The centrifugal force around the forming roll forces water and fiber towards the outer wire limiting the fiber penetration into the structured fabric. Use of vacuum at the wet shaping box helps pull fibers deeper into the fabric, but the total penetration is much less than the void volume available in the fabric. A limitation of the NTT process is that the absorbent structure has to be pressed into the structured fabric which creates compaction that limits absorbency and softness potential.

There is a need in the art for a paper making machine whereby a web is pressed deeply into a structuring fabric in an efficient manner.

SUMMARY OF THE INVENTION

An object of the present invention is to provide a superior method for producing absorbent structures by directly forming and draining a nascent web through a structured fabric. Advantageously, in accordance with exemplary embodiments of the present invention, no fabric crepe, vacuum, or pressing is required to force the web that forms the absorbent structure into the structured fabric. Further, the nascent web is nearly 99.5% water during initial drainage through the structured fabric. This highly viscous nascent web can, therefore, penetrate deeply into the structured fabric using the centrifugal force from the forming roll to allow for high levels of total bulk generation with low coarseness structured fabrics. This preserves the smooth surface of the nascent web while still allowing for high levels of bulk, softness and absorbency.

A method of forming a fibrous web according to an exemplary embodiment of the present invention comprises: providing a fiber slurry; depositing the fiber slurry between an inner forming wire and an outer forming wire, wherein the outer forming wire comprises a structured fabric and the inner forming wire contacts a segment of a forming roll; and rotating the forming roll so that the fiber slurry moves into contact with the structured fabric.

In an exemplary embodiment, the step of depositing is performed by a single layer headbox, a double layer headbox or a triple layer headbox.

In an exemplary embodiment, fiber within the fiber slurry comprise natural fibers, synthetic fibers or a combination of natural and synthetic fibers.

In an exemplary embodiment, the fiber slurry comprises up to 99.95% water.

In an exemplary embodiment, the method further comprises the step of draining the fiber slurry through the structured fabric.

In an exemplary embodiment, the method further comprises: separating the inner forming wire from the outer forming wire; and applying negative pressure from a vacuum box located on an underside of the outer forming wire to adhere a web formed from the fiber slurry to the outer forming wire.

In an exemplary embodiment, the method further comprises the step of dewatering the web by passing the web across one or more vacuum boxes.

In an exemplary embodiment, the method further comprises the step of drying the web, the drying step performed using a belt press having a hot air impingement hood, through air drying cylinders with associated air recirculation systems, or pressure rolls and steam heated cylinders with or without hot air impingement hoods.

In an exemplary embodiment, the method further comprises the step of creping the web from a steam heated cylinder.

In an exemplary embodiment, the method further comprises the steps of calendering and reeling the web.

In an exemplary embodiment, the structured fabric comprises woven monofilaments, the woven monofilaments comprising synthetic polymers.

In an exemplary embodiment, the synthetic polymers comprise polyethylene, polypropylene or nylon.

In an exemplary embodiment, the structured fabric further comprises an overlaid resin.

In an exemplary embodiment, the structured fabric is formed by laying down successive layers of material under computer control.

In an exemplary embodiment, the process of laying down successive layers of material comprises: Fused Deposition Modeling (FDM), PolyJet Technology, Selective Laser Melting (SLM), Direct Metal Laser Sintering (DMLS), Selective Laser Sintering (SLS), Stereolithography (SLA), or Laminated Object Manufacturing (LOM)

A wet section of a paper forming machine according to an exemplary embodiment of the present invention comprises: a headbox; a forming roll disposed adjacent to the headbox; an inner forming wire in contact with the forming roll, the inner forming wire configured to run around the forming roll; and an outer forming wire comprising a structured fabric, wherein the headbox is configured to deliver a fiber slurry to an area between the inner forming wire and the outer forming wire.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
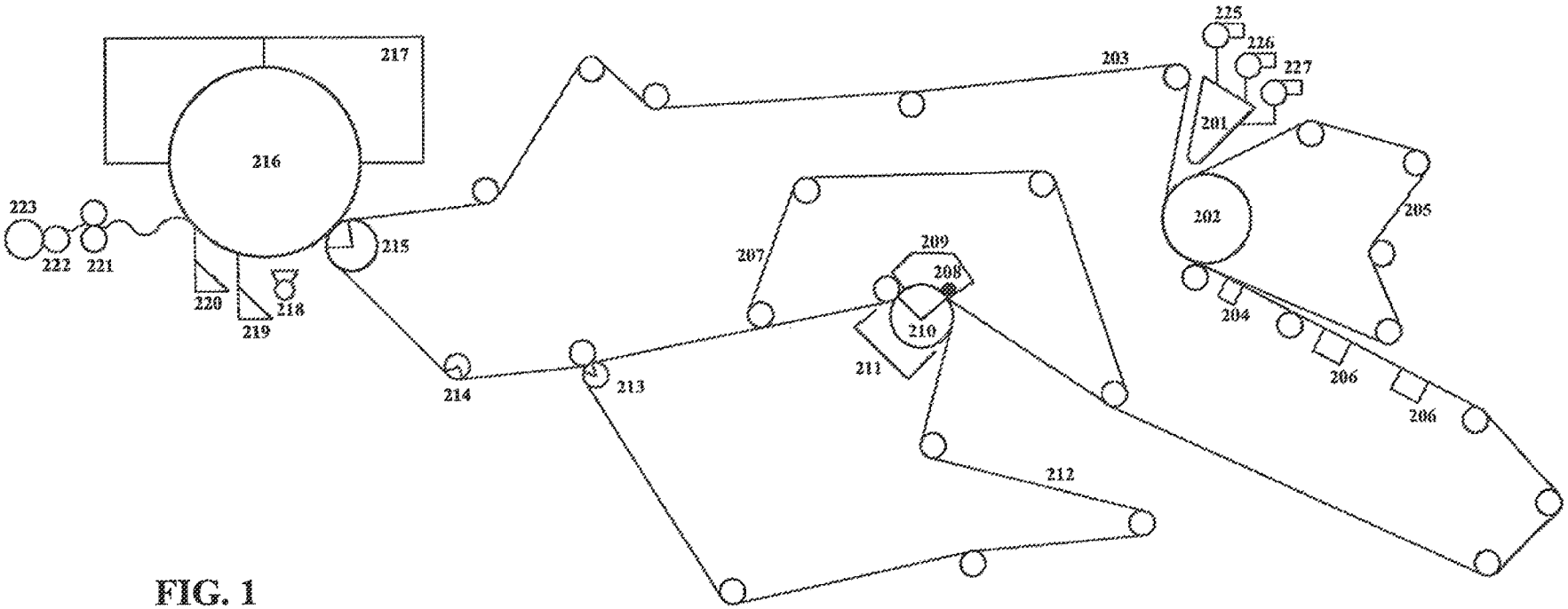
FIG. 1 is a schematic diagram of a paper making machine according to exemplary embodiments of the present invention.

FIG. 1 is a schematic diagram of a paper making machine for manufacturing absorbent structures according to an exemplary embodiment of the present invention. The machine includes one or more pumps, which move dilute slurry to a headbox. For example, FIG. 1 shows a first exterior layer fan pump 225, a core layer fan pump 226, and a second exterior layer fan pump 227. The fan pumps 225, 226, 227 move the dilute slurry of fiber and chemicals to a triple layer headbox 201. It will be understood that headboxes with a different number of layers may be used in embodiments of the invention.

Headbox 201 deposits the slurry into a forming surface comprising a outer structured fabric and an inner forming wire. As shown, in embodiments of the invention, the forming surface is a nip formed by an inner forming wire 205 which runs around forming roll 202, and an outer forming wire 203. In embodiments of the invention, outer forming wire 203 is a woven or polymer overlaid structured fabric ("outer forming wire" and "structured fabric" may be used interchangeably herein below). The slurry is drained through the structured fabric to form a web.

In embodiments of the invention, the slurry contains up to 99.95% water, fibers (either natural, synthetic or a combination of both), chemical polymers, and additives.

In embodiments of the invention, because the outer forming wire 203 is a structured fabric, the centrifugal force created by the rotating forming roll 202 forcefully presses the highly viscous nascent web into the structured fabric of the outer forming wire 203. As a result, the web penetrates deeply into the structured fabric allowing for high levels of total bulk generation with low coarseness structured fabrics.

In embodiments of the invention, the structured fabric is a woven structure that is formed of monofilaments (e.g. yarns, threads) composed of synthetic polymers (preferably polyethylene, polypropylene, or nylon). In embodiments of the invention, the structured fabric is provided with a hardened, cured overlaid resin.

It will be understood that the structured fabric may be manufactured using any of various processes for forming a three-dimensional object, but most preferably through an additive processes in which successive layers of material are laid down under computer control. These processes are generally classified as 3-D printing technologies. For example, these processes include but are not limited to any of the following: Fused Deposition Modeling (FDM), PolyJet Technology, Selective Laser Melting (SLM), Direct Metal Laser Sintering (DMLS), Selective Laser Sintering (SLS), Stereolithography (SLA), or Laminated Object Manufacturing (LOM).

In embodiments of the invention, after passing through the forming surface, the inner forming wire 205 separates from the web, and the web is then carried on the structured fabric 203. In embodiments of the invention, a vacuum box 204 is used to assist in web adherence to structured fabric 203. The web is preferably conveyed across one or more dewatering boxes 206 to facilitate dewatering and imprinting the structure of the structured fabric into the web.

After passing the one or more dewatering boxes 206, the web is conveyed on the structured fabric 203 to a belt press. In embodiments of the invention, the belt press is comprised of a permeable belt 207 which contacts the inner (non-web supporting) side of the structured fabric 203 and a permeable dewatering fabric 212, which contacts the web. Preferably, a hot air impingement hood 209 is provided within the belt press that contains a steam shower 208, and a vacuum roll 210. In embodiments of the invention, vacuum roll 210 has through and blind drilled holes in its cover (rubber or polyurethane in different embodiments of the invention). The web is heated by the steam and hot air of the hot air impingement hood 209 to lower the viscosity of the water within the web which is being pressed by the belt press to move the water into the dewatering fabric 212 and into the vacuum roll 210. The vacuum roll 210 holds a significant portion of the water within the through and blind drilled holes in the roll cover until vacuum is broken at the exit of the vacuum box, upon which time the water is deposited into a save-all pan 211. The air flow through the web, provided by the hot air hood 209 and vacuum of the vacuum roll 210, also facilitates water removal as moisture is trapped in the air stream. At this stage, the web properties are influenced by factors such as the structured fabric design and low intensity pressing. The bulk softness of the web is preserved due to the low intensity nip of the belt press which will not compress the web portions within the valleys of the structured fabric 203. The smoothness of the web is influenced by the unique surface topography imprinted by the structured fabric 203 which is dependent on the parameters of weave pattern, mesh, count, weft and warp monofilament diameter, caliper and percentage of the fabric that is knuckle verses valley.

In embodiments of the invention, after exiting the belt press, the web then travels through a second press comprised of a hard roll and soft roll. Press roll 213 located on the inside surface of the dewatering fabric 212 contains a vacuum box to facilitate water removal as the web passes through the nip of the hard and soft rolls. Thereafter, the web is transported by the structured fabric 203 to a wire turning roll 214 (having an optional vacuum box) to a nip between a blind and through drilled polyurethane or rubber covered press roll 215 and steam heated pressure cylinder 216. In embodiments of the invention press roll 215 is a solid polyurethane or rubber roll without vacuum. The web solids are up to 50% solids as the web is transferred to the steam heated cylinder 216. Heated cylinder 216 is preferably coated with chemicals that improve web adhesion to the dryer, improve heat transfer through the web, and assist in web removal at the creping doctor 220. The chemicals are constantly being applied using a sprayboom 218, while excess chemical is removed using a cleaning doctor blade 219. The web is dried by the steam heated cylinder 216 along with an installed hot air impingement hood 217 to a solids content of around 97.5%. The web is removed from the steam heated cylinder 216 using a ceramic doctor blade 220 with a pocket angle of 90 degrees at the creping doctor. At this stage, the web properties are influenced by the creping action occurring at the creping doctor. A larger creping pocket angle will increase the frequency and fineness of the crepe bars imparted to the web's first exterior surface, which improves surface smoothness. In one preferred embodiment of the invention, a ceramic doctor blade is used which allows for a fine crepe bar pattern to be imparted to the web for a long duration of time as compared to a steel or bimetal blade. The creping action imparted at the blade also improves web flexibility, which is improved as the web adherence to the dryer is increased. The creping force is influenced by the chemistry applied to the steam heated cylinder, the percentage of web contact with the cylinder surface which is a result of the knuckle pattern of the structured fabric, and the percent web solids upon creping.

Subsequent to the creping step, the web optionally travels through a set of calenders 221 running, for example, 15% slower than the steam heated cylinder. The action of calendering improves sheet smoothness but results in lower bulk softness by reducing overall web thickness. The amount of calendering can be influenced by the attributes needed in the finished product. For example, a low sheet count, 2-ply, rolled sanitary tissue product will need less calendering than the same roll of 2-ply sanitary product at a higher sheet count and the same roll diameter and firmness. Thus, the thickness of the web may need to be reduced using calendering to allow for more sheets to fit on a roll of sanitary tissue given limitations to roll diameter and firmness. After calendering, the web is reeled using a reel drum 222 into a parent roll 223.

The parent roll 223 can be converted into 1 or 2-ply rolled sanitary or towel products or 1, 2, or 3 ply folded facial tissue products.

Figure 2:
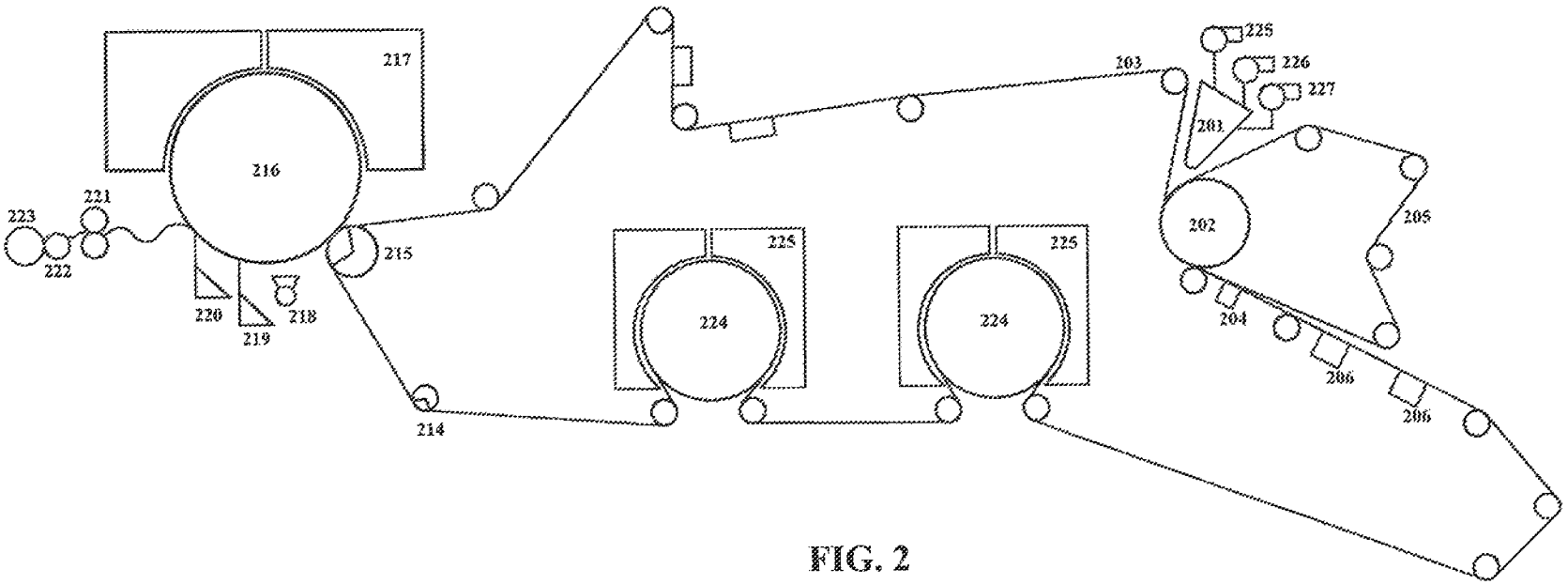
FIG. 2 is a schematic diagram of a paper making machine according to another exemplary embodiment of the present invention.

FIG. 2 shows an alternate drying section of a system for manufacturing absorbent structures according to an exemplary embodiment of the present invention. As shown, rather than traveling through a belt press, the web travels with the structured fabric 203 through two Through Air Dryers ("TADs") before being transferred to the steam heated cylinder 216 for final drying and creping. The airflow from each TAD dryer flows out of the TAD drums 224 into a hood and duct system 225 where the air is reheated using a burner, preferably fired using natural gas, and recirculated back through the TAD drums 224. The airflow and pressure from the TAD drum 224, along with the design of the TAD drum 224, is sufficient to prevent the web from coming into direct contact with the drum surface thereby preventing any defects being incorporated into the web.

In other embodiments of the invention, rather than adhering the web to a steam heated cylinder, the web can be removed from the structured fabric to directly proceed to the calendering section. Any variety of methods can be used to remove the web from the structured fabric. For example, rather than vacuum being supplied to the pressure roll, positive air pressure is used to transfer the sheet from the structured fabric onto a vacuum roll. The vacuum roll contains a vacuum zone and a zone with positive air pressure used to release the sheet from the roll and allow it to proceed through the calenders. A tube threader system may be used to thread the sheet from this vacuum roll through the calenders and reel drum after a web break. A similar system is used to thread after a break from the creping doctor when a steam heated cylinder is utilized.

Having described this invention with regard to specific embodiments, it is to be understood that the description is not meant as a limitation since further modifications and variations may be apparent or may suggest themselves to those skilled in the art. It is intended that the present application cover all such modifications and variations.

What is claimed is:

1. A method of forming a fibrous web on a paper making machine, comprising the steps of:

depositing a fiber slurry between an inner forming wire and an outer forming wire of the paper making machine, wherein the outer forming wire comprises a structured fabric.

2. The method of claim 1, wherein the step of depositing is performed by a single layer headbox, a double layer headbox or a triple layer headbox.

3. The method of claim 1, wherein fiber within the fiber slurry comprise natural fibers, synthetic fibers or a combination of natural and synthetic fibers.

4. The method of claim 1, wherein the fiber slurry comprises up to 99.95% water.

5. The method of claim 1, further comprising the step of draining the fiber slurry through the structured fabric.

6. The method of claim 5, further comprising:

separating the inner forming wire from the outer forming wire; and applying negative pressure from a vacuum box located on an underside of the outer forming wire to adhere a web formed from the fiber slurry to the outer forming wire.

7. The method of claim 6, further comprising the step of dewatering the web by passing the web across one or more vacuum boxes.

8. The method of claim 6, further comprising the step of drying the web, the drying step performed using a belt press having a hot air impingement hood, through air drying cylinders with associated air recirculation systems, or pressure rolls and steam heated cylinders with or without hot air impingement hoods.

9. The method of claim 8, further comprising the step of creping the web from a steam heated cylinder.

10. The method of claim 8, further comprising the steps of calendering and reeling the web.

11. The method of claim 1, wherein the structured fabric comprises woven monofilaments, the woven monofilaments comprising synthetic polymers.

12. The method of claim 11, wherein the synthetic polymers comprise polyethylene, polypropylene or nylon.

13. The method of claim 11, wherein the structured fabric further comprises an overlaid resin.

14. The method of claim 1, wherein the structured fabric is formed by laying down successive layers of material under computer control.

15. The method of claim 14, wherein the process of laying down successive layers of material comprises: Fused Deposition Modeling (FDM), PolyJet Technology, Selective Laser Melting (SLM), Direct Metal Laser Sintering (DMLS), Selective Laser Sintering (SLS), Stereolithography (SLA), or Laminated Object Manufacturing (LOM).

* * * * *